United States Patent [19]

Ohmori

[11] 4,430,602

[45] Feb. 7, 1984

[54] ELECTRONIC FLASH DEVICE

[75] Inventor: Kouichi Ohmori, Zushi, Japan

[73] Assignee: Canon Kabushiki Kaisha, Tokyo, Japan

[21] Appl. No.: 383,247

[22] Filed: May 28, 1982

[30] Foreign Application Priority Data

Jun. 11, 1981 [JP] Japan ..... 56-88899

[51] Int. Cl.[3] ..... H05B 41/32

[52] U.S. Cl. ..... 315/241 P; 315/135; 354/127.12; 354/145.1

[58] Field of Search ..... 315/129, 135, 136, 241 P; 354/127, 145; 340/660, 661; 320/1

[56] References Cited

U.S. PATENT DOCUMENTS 4,100,459 7/1978 Nakamura et al. ..... 315/135 X 4,258,297 3/1981 Nakajima ..... 315/241 P

FOREIGN PATENT DOCUMENTS 55-52036 4/1980 Japan ..... 315/136

*Primary Examiner*—Eugene R. LaRoche

*Attorney, Agent, or Firm*—Toren, McGeady and Stanger

[57] ABSTRACT

In the disclosed device, a DC-DC converter boosts the output of a battery to charge a capacitor that stores electrical energy to be converted into light energy and turns on a neon tube when the capacitor voltage reaches a first predetermined value. A control arrangement disables the converter in response to the neon tube turning on the re-enables the converter when the capacitor charge drops to the first predetermined level after the neon tube turns on.

8 Claims, 4 Drawing Figures

ELECTRONIC FLASH DEVICE

BACKGROUND OF THE INVENTION

This invention relates to an electronic flash device and more particularly to a flash device which produces a flash by impressing a charge of a capacitor across a flash tube.

In devices of this type, the voltage of a DC power source such as a battery or the like is applied to a DC-DC converter, for example, through a two-position power source switch. The voltage is thus converted into a predetermined high DC voltage by the DC-DC converter. A capacitor is charged with this high DC voltage. The charge voltage of the capacitor is impressed on a flash tube to produce a flash of light. The DC-DC converter is controlled on the basis of the charge voltage of the capacitor in such a way as to make the high DC voltage which is obtained as the output of the converter approximately constant. In the conventional device, however, the energy of the battery is consumed rapidly because the DC-DC converter is incessantly in operation. In another type of conventional device, A DC-DC converter which is composed of devices such as a transistor oscillator, etc. is arranged to stop oscillating in response to lighting of a display device arranged to indicate the charge state of the capacitor. The oscillation of the converter is arranged to resume when the charge voltage of the capacitor becomes lower than a value at which the display device lights up and when the light of the display device is thus extinguished. Power consumption can be lowered by this arrangement. However, in cases where a discharge tube such as a neon tube is employed as the display device, there is a difference between the lighting voltage and the extinguishing voltage. Then, this voltage difference causes a variation in the amount of light to be emitted by a flash tube. With conventional devices of this type it is hardly possible to carry out a satisfactory photographic operation.

SUMMARY OF THE INVENTION

It is therefore an object of the present invention to provide an electronic flash device which ensures flash light emission in nearly constant quantity with a low degree of power consumption.

It is another object of the invention to provide an electronic flash device which has the above-stated advantages with simple structural arrangement.

These objects, features and advantages of the invention will become apparent from the following detailed description of preferred embodiments thereof taken in connection with the accompanying drawings.

DETAILED DESCRIPTION OF PREFERRED EMBODIMENTS

Figure 1:
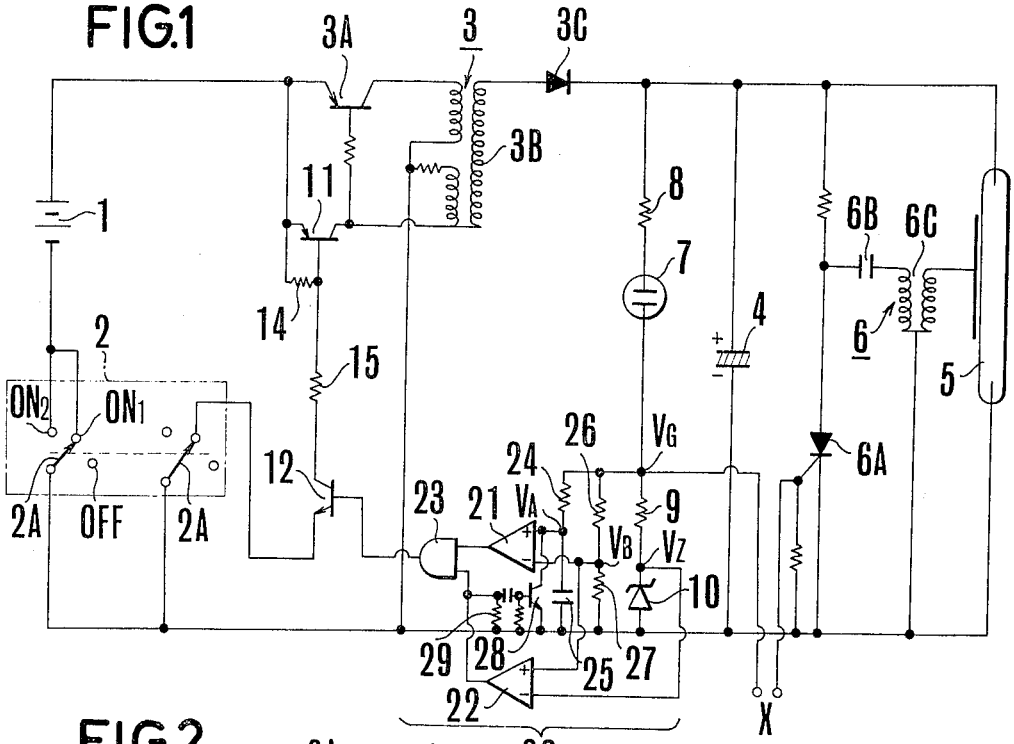
FIG. 1 is a circuit diagram showing an electronic flash device embodying the present invention.

FIG. 1 is a circuit diagram showing an electronic flash device embodying the invention. The device includes a DC power source or battery 1; a power source switch 2 and a DC-DC converter 3. The switch 2 is connected to the battery 1 to control power supply to a load and is arranged to permit selection of the operating mode of an arrangement for controlling the oscillation of the DC-DC converter 3. The switch is, for example, a two-circuit, three position switch. The DC-DC converter 3 is composed of an oscillating transistor 3A an oscillation transformer 3B and a diode 3C. The oscillating transistor 3A is connected in series with the primary winding of the oscillation transformer 3B and one circuit of the power source switch 2. The oscillation transformer 3B is the oscillating transistor 3A. The diode 3C rectifies the output of the oscillation transformer 3B. The embodiment includes a main capacitor 4 which is charged to the polarity shown in the drawing with a high DC voltage rectified through the diode 3C. A flash tube 5 is connected in parallel with the main capacitor 4. The flash tube 5 is provided with a trigger circuit 6 which is composed of a thyristor 6A arranged to be triggered by a predetermined gate signal from the outside X; a capacitor 6B for triggering; and a trigger transformer for causing the flash tube 5 to flash by impressing a high voltage on the tube 5 with a value corresponding to the charge voltage of the main capacitor 4 impressed through the triggering capacitor 6B when the thyristor 6A is energized.

The embodiment further includes a neon tube 7 which is connected in parallel with the main capacitor 4 through resistors 8 and 9 and a Zener diode 10. The neon tube 7 is arranged to indicate the charge state of the main capacitor 4. Reference numerals 11 and 12 indicate transistors arranged to control the oscillation of the DC-DC converter 3. The transistor 11 has its emitter and its base respectively connected to the emitter and the base of the oscillating transistor 3A throug a resistor 13. A resistor 14 is connected between the base and the emitter of the transistor 11. The other transistor 12 has its collector connected to the base of the transistor 11 through a resistor 15 and its emitter connected to the contact of one circuit of the power source switch 1. The base of the transistor 12 is connected to the output terminal of a comparison circuit 20. The comparison circuit 20 includes a first comparator 21, a second comparator 22 and an AND gate 23 which is provided for the purpose of obtaining an AND condition of the outputs of the first and second compartors 21 and 22. The potential $V_A$ of an integrating capacitor 25 which integrates impressed voltage obtained from the potential $V_G$ of one pole of neon tube 7 through a resistor 24 is applied to the non-inverting output terminal of the comparator 21. To the inverting output terminal of the comparator 21 receives a voltage value $V_B$ which is obtained with the potential $V_G$ of one pole of the neon tube 7 divided by voltage dividing resistors 26 and 27. The second comparator 22 receives the potential $V_B$ at its non-inverting input terminal and receives a Zener voltage $V_Z$ from the anode of the Zener diode 10 at its inverting input terminal. A transistor 28 temporarily discharges the electrical charge of the integrating capacitor 25. The collector and emitter of the transistor 28 are connected in parallel with the integrating capacitor 25. Meanwhile, the base of the transistor 28 is connected through a trigger circuit 29 to the output terminal of the second comparator 22.

Figure 3:
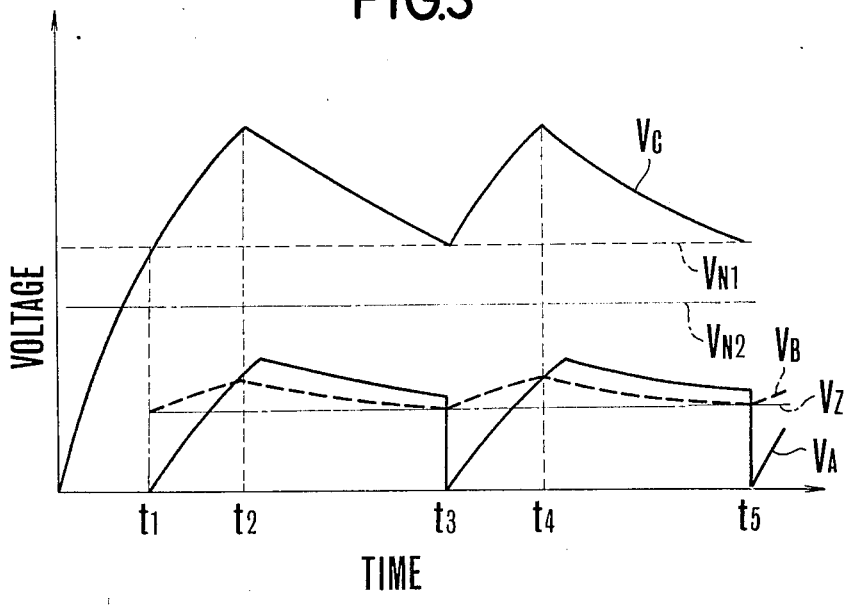
FIGS. 3 and 4 are graphical representations showing respective voltage variations at various parts shown in FIGS. 1 and 2 in relation to time.

The operation of the embodiment which is arranged as described in the foregoing will be understood from the following description with reference to the circuit diagram of FIG. 1 and the graph of FIG. 3 which shows variations in voltage values of various parts in relation to time. FIG. 3 includes the voltage value $V_A$ of the integrating capacitor 25; the voltage $V_B$ of the connecting point of the resistors 26 and 27; the charge voltage $V_C$ of the main capacitor 4; the lighting voltage $V_{N1}$ of the neon tube 7; and the extinguishing voltage $V_{N2}$ of the neon tube 7.

When the moving contact 2A of the power source switch 2 is set into a position ON1, current flows from the battery 1 through the primary sides of the oscillating transistor 3A and oscillating transistor 3B to cause oscillation to begin. This oscillation induces a high voltage at the secondary winding of the oscillating transistor 3B. Then, the main capacitor 4 is charged with a high DC voltage rectified through te diode 3C. When the charge voltage $V_C$ of the main capacitor 4 reaches the lighting voltage $V_{N1}$ of the neon tube 7 as indicated at t1 in FIG. 3, current flows through the resistor 8, the neon tube 7, the resistor 9 and the Zener diode 10. This flow of current then produces a Zener voltage $V_Z$ across the ends of the Zener diode 10 and a given voltage is impressed on the inverting input terminal of the second comparator 22 while a divided voltage $V_B$ obtained through the voltage dividing resistors 26 and 27 is impressed on the non-inverting input terminal of the comparator 22. The resistance values of the resistors 26 and 27 are selected to make the voltage $V_B$ either a little higher than or about equal to the voltage $V_Z$ when the neon tube 7 lights up. Therefore, the output of the second comparator 22 becomes high (hereinafter called "H").

Meanwhile, the integrating capacitor 25 is charged through the resistor 24 at a predetermined time constant. The charge voltage of the integrating capacitor 25 is impressed on the non-inverting input terminal of the first comparator 21. The divided voltage $V_B$ obtained at the resistors 26 and 27 is impressed on the inverting input terminal of the first comparator 21. Therefore, assuming a condition of $V_A > V_B$ at t=t2, the output of the first comparator 21 becomes "H". At this time, since the output of the first comparator 21 is "H" as mentioned above, the output of the AND gate 23 becomes "H" to turn on the transistor 12. Accordingly, a base bias is applied to the transistor 11 to turn it on. Then, the oscillating transistor 3A is turned off to bring its oscillation to a stop. With the oscillation thus coming to a stop, the voltage $V_C$ of the main capacitor begins to decrease as shown in FIG. 3. This causes the current of the neon tube 7 to decrease to lower the voltage $V_G$ on the cathode of the neon tube 7. Then, according to the decrease of the voltage $V_G$, the voltage $V_A$ of the integrating capacitor, the voltage $V_B$ of the connecting point of the resistors 26 and 27 also gradually decrease as shown in FIG. 3. When the voltage $V_B$ becomes lower than the Zener voltage $V_Z$ in the vicinity of t=t3 as shown in FIG. 3, the output of the second comparator 22 changes from "H" to "L". Then, the output of the AND gate 23 also changes from "H" to a low level (hereinafter called "L"). Accordingly, the transistors 12 and 11 are turned off and the oscillating transistor 3A turned on to resume the oscillation thereof.

With the oscillation of the oscillating transistor 3A resumed, the voltage $V_C$ of the main capacitor 4 increases and, accordingly, the voltages $V_A$ and $V_B$ also increase. With the voltage increased in this manner, when there obtains a condition of $V_B \geqq V_Z$ at t=t3, again the output of the second comparator 22 becomes "H". This output of the second comparator 22 is differentiated by the trigger circuit 29 to momentarily turn on the transistor 28. This causes the integrating capacitor 25 to discharge its electric charge. Then, charging of the capacitor 25 begins again from the zero level at t≅t3 on the basis of the time constant defined by the resistor 24 and the capacitor 25. When this charge voltage $V_A$ becomes $V_A \geqq V_B$ at t=t4, the output of the first comparator 21 becomes "H" and the output of the AND gate 23 also becomes "H". Therefore, the oscillation of the oscillating transistor 3A comes to a stop in the same manner as described in the foregoing. Thereafter, the same action as those described above are repeated.

When the moving contact 2A of the power source switch 2 is shifted to another position ON2, the oscillation and charging processes take place in the same manner as in the case of the moving contact being connected to the other point or position ON1. Then, when the charge voltage $V_C$ of the capacitor reaches the lighting voltage of the neon tube 7, the neon tube 7 lights up. However, since the emitter side of the transistor 12 is cut off by the power source switch 2, the transistors 12 and 11 are not turned on and oscillation is not interrupted. Accordingly, the capacitor is charged to a full extent in this case.

In carrying out a continuous photographic operation using a camera with the above-described automatic light adjusting flash device incorporated therein, the power source switch 2 is set in the position ON2 to have the capacitor charged to its full extent while the flash tube 5 is triggered to produce a flash. In a non-continuous photographic operation where there is a time interval between one shot and another, the power source switch 2 is set in the other position ON1. With the switch 2 set in the position ON1, after the first lighting of the neon tube 7, the operation of the DC-DC converter 3 is intermittently controlled to have the charge voltage of the capacitor above the lighting voltage of the neon tube 7 as shown in FIG. 3. In accordance with the invention, therefore, an energy saving condition can be obtained to lessen the consumption of the battery by selecting one of the two positions of the power source switch 2 for a non-continuous photographing operation. Further, as mentioned in the foregoing, after the neon tube 7 is first lit up by closing of the power source switch, no extinguished condition occurs so that less variation of light can be obtained. Accordingly, in case where a synchronizing device of the camera is arranged to be actuated by the neon tube 7, the possibility of non-synchronism can be eliminated.

Figure 2:
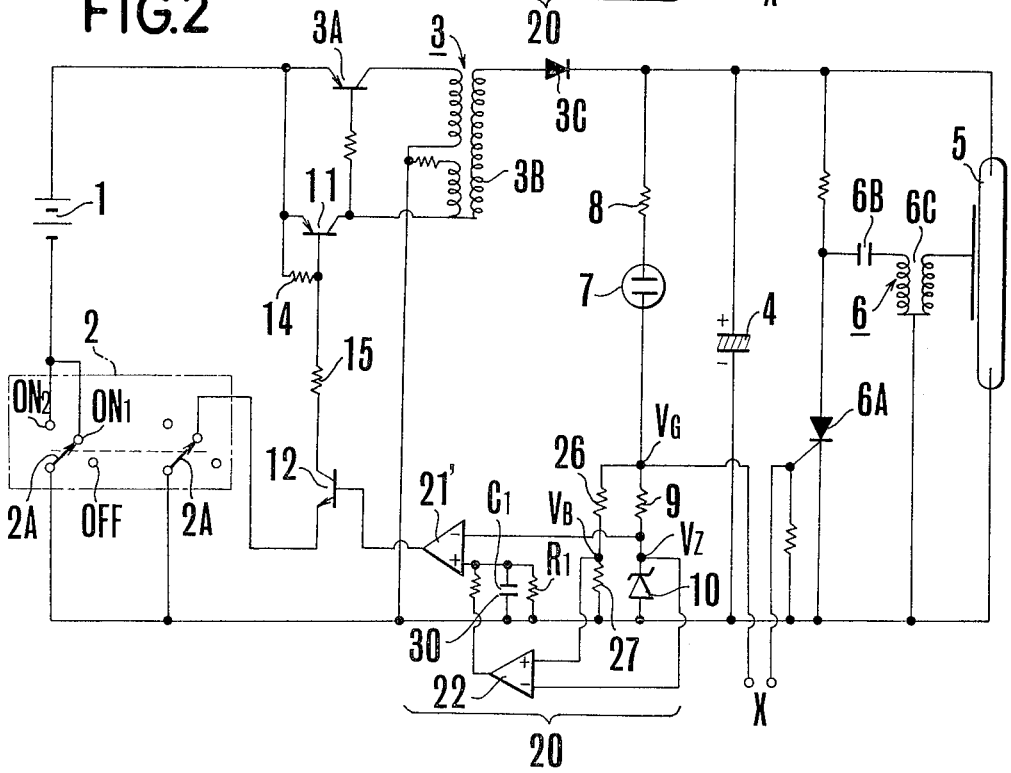
FIG. 2 is a circuit diagram showing an electronic flash device representing another embodiment of the invention.

Another embodiment of the invented electronic flash device is as shown in FIG. 2 in a circuit diagram. In FIG. 2, the same parts as those shown in FIG. 1 are indicated by the same reference numerals and, therefore, are omitted from the following description.

In this embodiment, a first comparator 21′ has a Zener voltage $V_Z$ impressed on the inversion input terminal thereof and has an integration circuit consisting of a resistor R1 and an integrating capacitor C1 connected to the non-inversion input terminal thereof. The integration circuit is arranged to perform an integrating action based on the time constant of the resistor R1 and the capacitor C1 starting from a time when the output of the second comparator 22 is produced.

Figure 4:
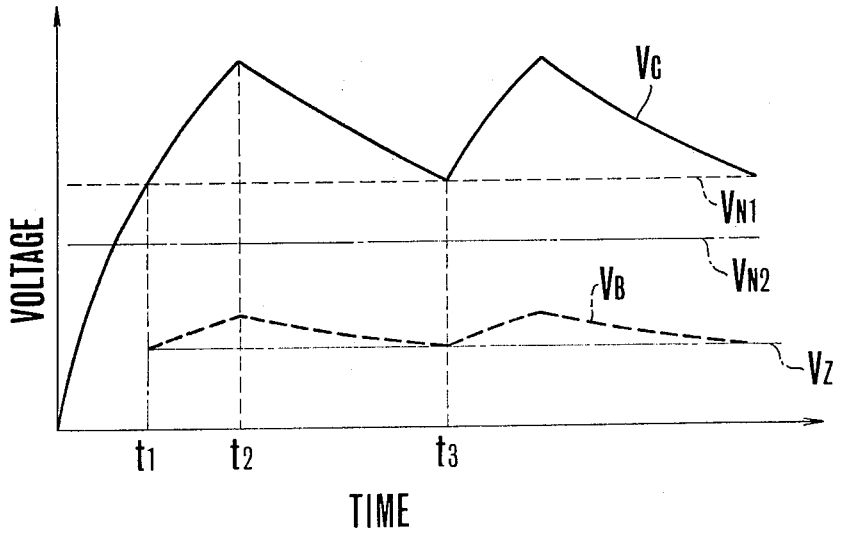

With the second embodiment arranged as described, when the moving contact 2A of the power source switch 2 is connected to the point or position ON1, the second embodiment operates as described below with reference to FIG. 4 which is a graph showing variations in the operating voltages of various parts in relation to time.

When the charge voltage $V_C$ of the main capacitor 7 exceeds the neon tube lighting voltage $V_{N1}$ at time t=t1, the neon tube 7 lights up to cause a current flow through the resistors 8 and 9 and the Zener diode 10. Then, since the voltage $V_B$ of the connection point of the resistors 26 and 27 and the Zener voltage $V_Z$ are selected to be $V_B \approx V_Z$, the output of the second comparator 22 becomes "H". This causes the integration circuit to operate. Then, when the output of the integration circuit exceeds the Zener voltage $V_Z$ at time t=t2, the output of the first comparator 21' becomes "H" and the action of the oscillating transistor 3A comes to a stop. This causes the charge voltage $V_C$ of the main capacitor to drop. Therefore, the cathode voltage $V_G$ of the neon tube 7 and the voltage $V_B$ of the connection point of the resistors 26 and 27 also drop. When the voltage $V_b$ becomes $V_B \approx V_Z$, the output of the second comparator 22 changes from "H" to "L". Accordingly, the output of the first comparator 21' also changes from "H" to "L". The transistors 12 and 11 are then turned off to cause the oscillating transistor 2 again to begin its operation. The same actions as those described above are repeated thereafter.

The second embodiment gives the same advantageous effects as the first embodiment. In addition to that, the second embodiment permits simplification of the structural arrangement of the comparison circuit 20.

As described in the foregoing, in the electronic flash device according to the present invention, the charging process for the capacitor is arranged to be intermittently carried out over a predetermined period of time to keep the charge voltage of the capacitor at least at a predetermined level or, for example, above a display lighting voltage, so that consumption of the battery can be lessened. Further, after the display device is first lighted by closing of the power source switch, light extinguishing condition arises, so that a less varying quantity of light can be obtained so as to obviate an adverse effect on the photographic operation. Where the electronic flash device according to the invention is applied to an automatic light adjusting flash device of a camera which has a synchronizing device arranged therein to be actuated by the neon tube, the arrangement of the invention to have the neon tube constantly lit eliminates the possibility of a non-synchronizing condition.

What is claimed is:

1. An electronic flash device comprising:

(a) a DC-DC converter for boosting the output of a battery;

(b) a capacitor to be charged with the output of said converter and for storing electrical energy to be converted into light energy;

(c) a neon tube for becoming operative when the charge of the capacitor reaches a first predetermined level; and (d) control means for rendering said converter inoperative in response to said neon tube becoming operative and to render the converter operative again when the charge of the capacitor drops to the first predetermined level after the neon tube becomes operative.

2. An electronic flash device according to claim 1, wherein said control means includes:

(a) detecting means for generating an output voltage corresponding to the charge of said capacitor;

(b) reference voltage producing means for producing an output voltage related to the first predetermined level; and (c) a comparator for comparing the output voltage of the detecting means with that of the reference voltage producing means, said comparator being arranged to produce a trigger signal to render the converter operative again when the output voltage of the detecting means becomes lower than the output voltage of the reference voltage producing means.

3. An electronic flash device comprising:

(a) a DC-DC converter arranged to boost the output of a battery;

(b) a capacitor to be charged with the output of said converter, said capacitor being arranged to store an electrical energy to be converted into a light energy;

(c) a neon tube for becoming operative when the level of the charge of the capacitor reaches a first predetermined level; and (d) control means arranged to render said converter inoperative in response to said neon tube becoming operative and to render the converter operative again before the output level of the capacitor drops to the first predetermined level after the neon tube becomes operative.

4. An electronic flash device according to claim 3, wherein said control means includes:

(a) detecting means for generating an output voltage corresponding to the charge of said capacitor;

(b) reference voltage producing means for producing an output voltage related to the first predetermined level; and (c) a comparator for comparing the output voltage of the detecting means with that of the reference voltage producing means, said comparator being arranged to produce a trigger signal to render the converter operative again when the output voltage of the detecting means becomes lower than the output voltage of the reference voltage producing means.

5. An electronic flash device according to claim 4, wherein said detecting means includes a voltage divider connected to said neon tube.

6. An electronic flash device according to claim 5, wherein said voltage divider consists of two resistors.

7. An electronic flash device according to claim 5, wherein said reference voltage producing means includes a Zener diode connected to the neon tube.

8. An electronic flash device comprising:

a DC-DC converter arranged to boost the output of a battery, a capacitor for storing electrical energy to be converted into a light energy, indicating means arranged to become operative when the level of the output of the capacitor reaches a first predetermined level and to become inoperative when the level of the output of the capacitor drops to a second predetermined level lower than the first predetermined level, and control means for rendering the converter inoperative in relation to a change of the indicating means into an operative state and for rendering the converter operative after the change of the indicating means into the operative state and before the output level of the capacitor drops to the second predetermined level.

* * * * *